US007092847B2

(12) United States Patent
Storch

(10) Patent No.: US 7,092,847 B2
(45) Date of Patent: Aug. 15, 2006

(54) METHOD OF EVALUATING THE PERFORMANCE OF A RELIEF PITCHER IN THE LATE INNINGS OF A BASEBALL GAME

(76) Inventor: Paul Storch, 22 Broadlawn Ave., Great Neck, NY (US) 11024

( * ) Notice: Subject to any disclaimer, the term of this patent is extended or adjusted under 35 U.S.C. 154(b) by 8 days.

(21) Appl. No.: 10/974,928

(22) Filed: Oct. 27, 2004

(65) Prior Publication Data

US 2005/0060121 A1 Mar. 17, 2005

Related U.S. Application Data

(63) Continuation-in-part of application No. 10/128,678, filed on Apr. 23, 2002, now abandoned.

(51) Int. Cl.
*G06F 11/30* (2006.01)
*G21C 17/00* (2006.01)

(52) U.S. Cl. ..... 702/182

(58) Field of Classification Search ..... 702/179–182, 702/189; 700/90–93; 273/292, 244, 244.1, 273/277, 317.6, 118 R; 463/2, 3, 7, 9
See application file for complete search history.

(56) References Cited

U.S. PATENT DOCUMENTS 6,170,829 B1 * 1/2001 Harvey ..... 273/298

* cited by examiner

*Primary Examiner*—Michael Nghiem
(74) *Attorney, Agent, or Firm*—Myron Greenspan, Esq.; Lackenbach Siegel LLP

(57) ABSTRACT

A method of evaluating the performance of a relief pitcher in the late innings of a baseball game factors through storage and processing of data as to when a pitcher inherits at least one player on base. The following steps of the method are disclosed: first, establishing the number of runs Ri scored by such inherited runners; second, establishing the number of batters B faced in such innings; third, establishing the number of outs; and, finally, evaluating the Relief Quotient "RQ" according to the formula:

$$RQ = k\left(\frac{Ri + E}{B}\right)^n,$$

where k is first a predetermined constant selected to scale the RQ to a desired range of magnitudes, n is a second predetermined constant that may be positive or negative and E is a parameter that may be an integer or equal to 0.

30 Claims, 10 Drawing Sheets

| RELIEF PITCHER ENTERS INNING | INNING FACTOR Fi | NO OUT FACTOR F0 | INHERITED RUNNERS R1 ON 1st BASE SCORES | FACTOR k1 | INHERITED RUNNERS R2 ON 2nd BASE SCORES | FACTOR k2 | INHERITED RUNNERS R3 ON 3rd BASE SCORES | FACTOR k3 | V0 |
|---|---|---|---|---|---|---|---|---|---|
| 1 | 0.00 | 0.00 | | 3.00 | | 2.00 | | 1.00 | 0.00 |
| 2 | 0.00 | 0.00 | | 3.00 | | 2.00 | | 1.00 | 0.00 |
| 3 | 0.00 | 0.00 | | 3.00 | | 2.00 | | 1.00 | 0.00 |
| 4 | 0.00 | 0.00 | | 3.00 | | 2.00 | | 1.00 | 0.00 |
| 5 | 0.00 | 0.00 | | 3.00 | | 2.00 | | 1.00 | 0.00 |
| 6 | 0.00 | 0.00 | | 3.00 | | 2.00 | | 1.00 | 0.00 |
| 7 | 1.00 | 0.00 | 1 | 3.00 | 0 | 2.00 | 1 | 1.00 | 4.00 |
| 8 | 2.00 | 0.50 | 4 | 3.00 | 3 | 2.00 | 2 | 1.00 | 50.00 |
| 9 | 3.00 | 1.00 | 2 | 3.00 | 2 | 2.00 | 3 | 1.00 | 52.00 |
| | TOTALS> >>>>>>> | | 7.00 | | 5.00 | | 6.00 | | 106.00 |
| TOTAL BATTERS FACED IN RELIEF w/o OUT | 90 | | RQ 1.18 | | | | | | |

Fig. 1A

| RELIEF PITCHER ENTERS INNING | INNING FACTOR Fi | ONE OUT FACTOR F1 | INHERITED RUNNERS R1 ON 1st BASE SCORES | FACTOR k1 | INHERITED RUNNERS R2 ON 2nd BASE SCORES | FACTOR k2 | INHERITED RUNNERS R3 ON 3rd BASE SCORES | FACTOR k3 | V1 |
|---|---|---|---|---|---|---|---|---|---|
| 1 | 0.00 | 0.00 | | 3.00 | | 2.00 | | 1.00 | 0.00 |
| 2 | 0.00 | 0.00 | | 3.00 | | 2.00 | | 1.00 | 0.00 |
| 3 | 0.00 | 0.00 | | 3.00 | | 2.00 | | 1.00 | 0.00 |
| 4 | 0.00 | 0.00 | | 3.00 | | 2.00 | | 1.00 | 0.00 |
| 5 | 0.00 | 0.00 | | 3.00 | | 2.00 | | 1.00 | 0.00 |
| 6 | 0.00 | 0.00 | | 3.00 | | 2.00 | | 1.00 | 0.00 |
| 7 | 1.00 | 0.00 | 1 | 3.00 | 0 | 2.00 | 1 | 1.00 | 4.00 |
| 8 | 2.00 | 1.50 | 4 | 3.00 | 3 | 2.00 | 2 | 1.00 | 70.00 |
| 9 | 3.00 | 2.00 | 2 | 3.00 | 2 | 2.00 | 3 | 1.00 | 65.00 |
| | TOTALS> | >>>>>>> | 7.00 | | 5.00 | | 6.00 | | 139.00 |
| TOTAL BATTERS FACED IN RELIEF W/ 1 OUT | 90 | | RQ 1.54 | | | | | | |

Fig. 1B

| RELIEF PITCHER ENTERS INNING | INNING FACTOR Fi | TWO OUT FACTOR F2 | INHERITED RUNNERS R1 ON 1st BASE SCORES | FACTOR k1 | INHERITED RUNNERS R2 ON 2nd BASE SCORES | FACTOR k2 | INHERITED RUNNERS R3 ON 3rd BASE SCORES | FACTOR k3 | V2 |
|---|---|---|---|---|---|---|---|---|---|
| 1 | 0.00 | 0.00 | | 3.00 | | 2.00 | | 1.00 | 0.00 |
| 2 | 0.00 | 0.00 | | 3.00 | | 2.00 | | 1.00 | 0.00 |
| 3 | 0.00 | 0.00 | | 3.00 | | 2.00 | | 1.00 | 0.00 |
| 4 | 0.00 | 0.00 | | 3.00 | | 2.00 | | 1.00 | 0.00 |
| 5 | 0.00 | 0.00 | | 3.00 | | 2.00 | | 1.00 | 0.00 |
| 6 | 0.00 | 0.00 | | 3.00 | | 2.00 | | 1.00 | 0.00 |
| 7 | 1.00 | 0.00 | 1 | 3.00 | 0 | 2.00 | 1 | 1.00 | 4.00 |
| 8 | 2.00 | 2.50 | 4 | 3.00 | 3 | 2.00 | 2 | 1.00 | 90.00 |
| 9 | 3.00 | 3.00 | 2 | 3.00 | 2 | 2.00 | 3 | 1.00 | 78.00 |
| | TOTALS> >>>>>>> | | 7.00 | | 5.00 | | 6.00 | | 172.00 |
| TOTAL BATTERS FACED IN RELIEF W/ 2 OUT | 90 | | RQ 1.91 | | | | | | |
| TOTAL BATTERS FACED IN RELIEF | 270 | | RQ 1.54 | | | | | | |

Fig. 1C

| RELIEF PITCHER ENTERS INNING | INNING FACTOR Fi | NO OUT FACTOR F0 | INHERITED RUNNERS R1 ON 1st BASE SCORES | FACTOR k1 | INHERITED RUNNERS R2 ON 2nd BASE SCORES | FACTOR k2 | INHERITED RUNNER R3 ON 3rd BASE SCORES | FACTOR k3 | V0 |
|---|---|---|---|---|---|---|---|---|---|
| 1 | 0.00 | 0.00 | | 3.00 | | 2.00 | | 1.00 | 0.00 |
| 2 | 0.00 | 0.00 | | 3.00 | | 2.00 | | 1.00 | 0.00 |
| 3 | 0.00 | 0.00 | | 3.00 | | 2.00 | | 1.00 | 0.00 |
| 4 | 0.00 | 0.00 | | 3.00 | | 2.00 | | 1.00 | 0.00 |
| 5 | 0.00 | 0.00 | | 3.00 | | 2.00 | | 1.00 | 0.00 |
| 6 | 0.00 | 0.00 | | 3.00 | | 2.00 | | 1.00 | 0.00 |
| 7 | 1.00 | 0.00 | 1 | 3.00 | 0 | 2.00 | 1 | 1.00 | 4.00 |
| 8 | 2.00 | 0.50 | 1 | 3.00 | 3 | 2.00 | 6 | 1.00 | 37.50 |
| 9 | 3.00 | 1.00 | 2 | 3.00 | 2 | 2.00 | 4 | 1.00 | 56.00 |
| | TOTALS> >>>>>>> | | 4.00 | | 5.00 | | 11.00 | | 97.50 |
| TOTAL BATTERS FACED IN RELIEF W/ 0 OUT | 64 | | RQ 1.52 | | | | | | |

Fig. 2A

| RELIEF PITCHER ENTERS INNING | INNING FACTOR Fi | ONE OUT FACTOR F1 | INHERITED RUNNERS R1 ON 1st BASE SCORES | FACTOR k1 | INHERITED RUNNERS R2 ON 2nd BASE SCORES | FACTOR k2 | INHERITED RUNNERS R3 ON 3rd BASE SCORES | FACTOR k3 | V1 |
|---|---|---|---|---|---|---|---|---|---|
| 1 | 0.00 | 0.00 | | 3.00 | | 2.00 | | 1.00 | 0.00 |
| 2 | 0.00 | 0.00 | | 3.00 | | 2.00 | | 1.00 | 0.00 |
| 3 | 0.00 | 0.00 | | 3.00 | | 2.00 | | 1.00 | 0.00 |
| 4 | 0.00 | 0.00 | | 3.00 | | 2.00 | | 1.00 | 0.00 |
| 5 | 0.00 | 0.00 | | 3.00 | | 2.00 | | 1.00 | 0.00 |
| 6 | 0.00 | 0.00 | | 3.00 | | 2.00 | | 1.00 | 0.00 |
| 7 | 1.00 | 0.00 | 1 | 3.00 | 3 | 2.00 | 5 | 1.00 | 14.00 |
| 8 | 2.00 | 1.50 | 3 | 3.00 | 1 | 2.00 | 5 | 1.00 | 56.00 |
| 9 | 3.00 | 2.00 | 5 | 3.00 | 2 | 2.00 | 5 | 1.00 | 120.00 |
| | TOTALS> | >>>>>>> | 9.00 | | 6.00 | | 15.00 | | 190.00 |
| TOTAL BATTERS FACED IN RELIEF W/ 1 OUT | 116 | | RQ 1.64 | | | | | | |

Fig. 2B

| RELIEF PITCHER ENTERS INNING | INNING FACTOR Fi | TWO OUT FACTOR F2 | INHERITED RUNNERS R1 ON 1st BASE SCORES | FACTOR k1 | INHERITED RUNNERS R2 On 2nd BASE SCORES | FACTOR k2 | INHERITED RUNNERS R3 ON 3rd BASE SCORES | FACTOR k3 | V2 |
|---|---|---|---|---|---|---|---|---|---|
| 1 | 0.00 | 0.00 | | 3.00 | | 2.00 | | 1.00 | 0.00 |
| 2 | 0.00 | 0.00 | | 3.00 | | 2.00 | | 1.00 | 0.00 |
| 3 | 0.00 | 0.00 | | 3.00 | | 2.00 | | 1.00 | 0.00 |
| 4 | 0.00 | 0.00 | | 3.00 | | 2.00 | | 1.00 | 0.00 |
| 5 | 0.00 | 0.00 | | 3.00 | | 2.00 | | 1.00 | 0.00 |
| 6 | 0.00 | 0.00 | | 3.00 | | 2.00 | | 1.00 | 0.00 |
| 7 | 1.00 | 0.00 | 0 | 3.00 | 0 | 2.00 | 0 | 1.00 | 0.00 |
| 8 | 2.00 | 2.50 | 0 | 3.00 | 1 | 2.00 | 4 | 1.00 | 27.00 |
| 9 | 3.00 | 3.00 | 0 | 3.00 | 2 | 2.00 | 6 | 1.00 | 60.00 |
| | TOTALS> >>>>>>> | | 0.00 | | 3.00 | | 10.00 | | 87.00 |
| TOTAL BATTERS FACED IN RELIEF W/ 2 OUT | 35 | | RQ 2.49 | | | | | | |
| TOTAL BATTERS FACED IN RELIEF | 215 | | RQ 1.74 | | | | | | |

Fig. 2C

METHOD OF EVALUATING THE PERFORMANCE OF A RELIEF PITCHER IN THE LATE INNINGS OF A BASEBALL GAME

CROSS REFERENCE TO RELATED APPLICATION

This application is a continuation-in-part of U.S. patent application Ser. No. 10/128,678 filed on Apr. 23, 2002, which is now abandoned.

BACKGROUND OF THE INVENTION

1. Field of the Invention

The invention generally relates to baseball and, more particularly, to a statistical method for evaluating the performance of a relief pitcher.

2. Description of the Prior Art

Baseball thrives, and in large measure survives, by its ability to evaluate, differentiate and classify its product—namely, its players and teams. This is true for hitters, for pitchers, and, to a lesser extent, for position players in the field.

Who had the best season at the plate? Generally speaking, the batting average tells us.

Who had the most productive season? Perhaps it's the slugging percentage or the Runs Batted In (RBI) that tells us. Or is it the statistic that indicates which player crossed home plate the most times (Runs Scored)? Or perhaps the statistic that states who had the best on-base average, or the most walks, or the most hits.

Measuring pitching performance has also been one of the most common subjects of statistics, and can be found in newspapers from the 1800s. Which pitcher won how many games? The won/loss columns tell us. This is the most widely used measure of a pitcher's worth. Which pitcher struck out the most batters? Which pitcher yielded the fewest walks? Which pitcher allowed the fewest hits? Which pitcher allowed the fewest batters to cross home plate due to his mistakes (the Earned Run Average, or "ERA")? This is the second most widely used measure of a pitcher's worth, after the total amount of "wins." Which pitcher had the most "saves," so to speak, out of the bullpen? A "save" is credited to a relief (or "substitute") pitcher when the pitcher who starts the game is removed from the game while his team is in the lead; the relief pitcher holds the opposite team in check so that his team remains ahead and goes on to win the game. (It has been said that the "blown save" is baseball's most "deflating moment, and its most haunting," *The New York Times*, Mar. 31, 2002, Sect. 8a, p. 3.)

The following is a more specific definition of a "save" in pitching: A pitcher can earn a save by completing all three of the following terms:

(1) Finishes the game won by his team;

(2) Does not receive the win;

(3) Meets one of the following three items:

(a) Enters the game with a lead of no more than three runs and pitches at least one inning;

(b) Enters the game with the tying run either on base, at bat or on deck; and/or (c) Pitches effectively for at least three innings.

The number of "saves" has been used for years as a measure of the value of a relief pitcher. Baseball is not immune to society's rush into specialization. Just as a general practitioner M.D. recommends a patient to a specialist, and an attorney might specialize in maritime law, baseball is becoming more and more specialized as to how it uses its players. Very few "complete"—nine-(or more)-inning games—are pitched by the starting pitchers. A manager will use a "pitch count" to determine how far his ace (the starting pitcher) can go. There are middle-inning (fifth–seventh inning) relief pitchers, and there are "closers," who finish pitching the game.

Relief pitching has become an art and a specialty. However, the statistics related to relief pitching have not kept pace.

Assume the following situation. Several relief pitchers have come into a different number of games and have "inherited" a different number of base runners. However, all of these relief pitchers end the season with similar numbers of saves. Because the actual games each pitcher entered can be widely disparate, a fixed number of saves—say, 15—might not have the same value for each pitcher. It's possible that reliever no. 1 pitched in twice as many games as reliever no. 2. Clearly, in such a case, "15 saves" would not mean that they are of equal value. And what of the situations in which each of these pitchers allowed runs or scores and did not "save" the game ("blown saves")?

Most of the baseball statistics we know are readily computed and reflect simple performance parameters. The common and not-so-common items used to measure pitching performance in the major leagues today include "Adjusted Pitching Runs" ("APR" or "PR/A"). This is an advanced pitching statistic used to measure the number of runs that a pitcher prevents from being scored compared to the League's average pitcher in a neutral park in the same amount of innings. This is similar to the "ERA" ("Earned Run Average") and acts as a quantitative counterpart.

The abovementioned ERA is simply computed by the following formula:

$$ERA = \frac{Rx9}{I}$$

where R=the number of earned runs and I=total no. of innings pitched.

The ERA is one of the oldest pitching statistics and is one of the most commonly used and understood statistics in the major leagues. Virtually every fan knows what it means, but many often forget the formula used to compute the pitcher's ERA.

The Earned Run Average Plus ("ERA+" or "RA") is computed by dividing the league ERA by the ERA of a pitcher. This statistic uses a league-normalized ERA in the calculation and is intended to measure how well the pitcher prevented runs from being scoring relative to pitchers in the rest of the league. It is similar to the Hitters' PRO statistic.

Another commonly used statistic is the "Walks and Hits per Innings Pitched" ("WHIP"), which is computed as follows:

$$WHIP = \frac{H + W}{I}$$

where H=number of hits, W=number of walks, and I=total number of innings pitched. There is a popular statistic that is probably used and frequently discussed in certain leagues. It was developed to measure the approximate number of walks and hits a pitcher allows in each inning he pitches, and then to compare the value received to other pitchers to formulate a pitcher's index.

The winning percentage is another common statistic in baseball and is also quite easy to understand and easy to compute. The primary purpose of this statistic is to gauge the percentage of a pitcher's games that are won.

In some instances, certain statistics become very sophisticated and more difficult to compute. Thus, for example, "Game Score" is computed as follows:

$$GAMESCORE = 50 + 3I - 2(H + R + E) - W + S + \frac{2}{I'}$$

where I=the number of innings pitched;
H=number of hits;
R=number of runs;
E=number of errors;
W=number of walks;
S=number of strikeouts; and
I'=the number of each full inning completed beyond the fourth inning.

This advanced pitching statistic is used to measure how dominant a pitcher's performance is in each game he pitches. This statistic rewards dominance (strikes and lack of hits) while penalizing for walks.

As it clear from the above, the number of statistics that are followed by baseball enthusiasts is rather large. Some of these statistics are, of course, more important than others to either the fans or the ball clubs.

While some of the aforementioned pitching statistics reflect a pitcher's general performance, only some of the statistics reflect the additional pressures and expectations of pitchers during critical phases of the game, when the pitchers are under particular stress. As noted, the "Game Score" is a function of full innings completed beyond the fourth inning and, therefore, reflects the performance of the pitcher toward the second half of the game. Most of the pitching statistics do not, however, reflect other parameters that are inherently stressful to all pitchers and that all good relief pitchers must overcome, including the number of outs, the number of inherited runners and the specific bases where each inherited runner is located when the relief pitcher comes on. As suggested, the number of outs, the number of inherited runners and the specific bases on which they are located, as well as the specific inning in which the pitcher comes in can, separately and in combination, be particularly stressful to a pitcher. The ability of a pitcher to overcome such stressful conditions and provide a win has never been quantified. This problem has been recently discussed in "Top Relievers: Earning Saves by Putting Out Others' Fires" in *The New York Times* (Jun. 27, 2004) Section 8, page 10. Although this problem has been well defined, to date there has been no practical solution to it.

SUMMARY OF THE INVENTION

Accordingly, it is an object of the invention to provide a method of evaluating the performance of a relief pitcher in the final innings of a baseball game that provides an accurate measure of a pitcher's performance and value of the pitcher under stressful and/or critical conditions and allows such relief pitchers to be more accurately compared on an objective and/or quantitative basis with other relief pitchers.

It is another object of the invention to provide a method, as in the previous object, that factors in parameters such as the number of the inning in which the relief pitcher is called in, the number of inherited runners, and the bases which they occupy, and the number of outs during the inning in which the relief pitcher is called in.

It is still another object of the invention to provide a method as in the previous objects which computes a "Relief Quotient" ("RQ") that is proportional to the total number of runs scored by inherited runners and inversely proportional to the total number of batters faced by the pitcher in the innings in which he pitches.

It is yet another object of the invention to provide a method of the type under discussion which is simple to compute and yet provides a sophisticated and more refined method of evaluating and comparing the performances of relief pitchers by considering the number of runs scored by inherited runners and the number of batters faced during the final innings, but which can be refined by also factoring in the specific innings in which the runs by the inherited runners are scored, as well as the number of outs when the relief pitcher is introduced into the game.

In order to achieve the above objects, as well as others that will become more apparent hereinafter, a method of evaluating the performance of a relief pitcher in the final innings of a baseball game in which the pitcher inherits at least one player on base comprises the steps of establishing the number of runs Ri scored by such inherited runners and establishing the number of batters B faced by the pitcher in such innings. The Relief Quotient (RQ), in accordance with the present invention, is evaluated by calculating it as follows:

$$RQ = k\left(\frac{Ri + E}{B}\right)^n$$

where k=a first predetermined constant selected to scale the RQ to a desired range of magnitudes; Ri=the number of runs scored by inherited runners; B=the number of batters faced by the pitcher in these innings; E is a second constant, and may be equal to the pitcher's ERA; and n=a predetermined positive or negative number normally equal to +1 or −1.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIGS. 1A, 1B and 1 C are three sections of the same spreadsheet that illustrate one computation of an RQ on the basis of certain game conditions when the relief pitcher is called in;

FIGS. 2A, 2B and 2C are similar to FIGS. 1A, 1B and 1C, but illustrate a second spreadsheet showing different game conditions and the resulting computation of a different RQ for the pitcher.

DESCRIPTION OF THE PREFERRED EMBODIMENTS

Figure 3A:
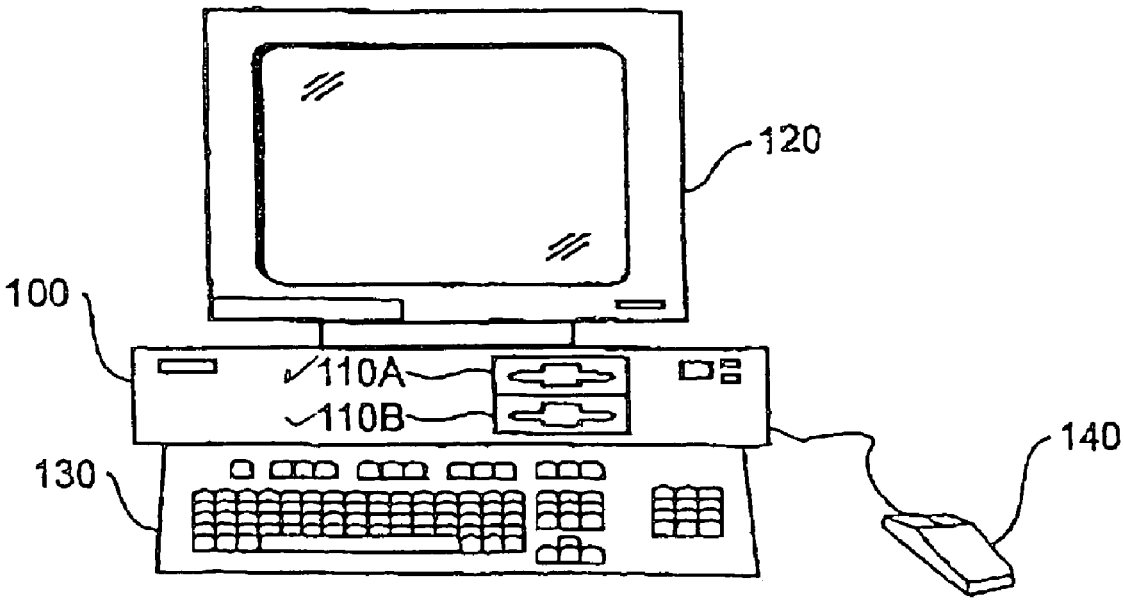
FIG. 3A is a view of an exemplary computer system suitable for use in carrying out the invention.

The attached FIGS. 1A, 1B and 1C and 2A, 2B and 2C are two spreadsheets illustrating examples of computations of Relief Quotients (RQs) in accordance with the present invention for two different relief pitchers. This RQ functions to more clearly define the value and performance of a relief pitcher. As things are now, a relief pitcher who comes into a game with his team ahead will, in circumstances previously described, receive a "save" (provided, of course, that the team stays ahead). But if several relief pitchers each have achieved the same number of saves, will each have the same value as a relief pitcher?

The current use of baseball statistics does not provide an accurate tool by which to measure the value of a relief pitcher. Fortunately, using the RQ statistic we can now more clearly define relief pitcher superiority and compare relief pitchers more objectively and/or quantitatively than heretofore.

For purposes of this invention, the RQ may either be computed on the basis of the number of outs that exist when the relief pitcher inherits players on base, or may be computed as a composite average for a given relief pitcher that reflects all instances in which players on base(s) are inherited with 0, 1 or 2 outs. Typically, the RQ is proportional to the number of runs Ri scored by players on base inherited by a relief pitcher, and inversely proportional to the total number of batters faced in the final innings of the game. Therefore, in its most fundamental or basic aspect, the RQ can be represented as follows:

$$RQ = k\left(\frac{Ri + E}{B}\right)^n$$

where k is a predetermined constant selected to scale the RQ to a selected range of magnitudes, and may be equal to "1". The exponent "n" may be +1 or −1, as to be more fully discussed below. In the initial embodiment discussed, the exponent is +1. However, as suggested, the RQ can be significantly refined to more fully reflect the value or performance of a relief pitcher in the final innings of the game. For purposes of discussing some such refinements, the following definitions will be used:

(1) The Inning Factors (Fi)—Preferably, these factors exist for the seventh, eighth, and ninth innings only. Through the sixth inning there is less pressure for a relief pitcher, as the game has a substantial amount of time left. As the game enters the seventh inning, the pressure mounts for the relief pitcher to hold the opposite team back. The "Inning Factor" variable "Fi" is increased as the game progresses through the seventh, eighth, and ninth innings, as the pressure increases and as the amount of time to correct a miscue decreases for a team. In short, the RQ reflects a greater penalty for failure as the game progresses.

(2) The Out Factors (F0, F1, F2)—the more outs there are when a relief pitcher enters the game, the more the reliever is penalized for a miscue. For example, if in the eighth inning with a runner on first base the pitcher allows the runner to score with one out he is penalized by a factor of 1.5; if he allows the runner to score with two outs the penalty "out factor" is 2.5. These factors are used because there is more pressure on the relief pitcher when he is pitching to a batter with, for example, two outs in the ninth inning than to a batter with no outs in that same inning. He is penalized more in these circumstances.

(3) The Base Factors (R1, R2, R3)—It takes a greater miscue to allow a runner to score from first base than it does to allow one to score from third base. Thus, the pitcher is penalized to a greater extent if the player on first scores under the same conditions as in a situation in which the player on third scores.

Turning now to specific examples of computations of RQs in accordance with a more refined formula in accordance with the invention, and first referring to FIGS. 1A, 1B and 1C, it should be noted that the tables or spreadsheets show cumulative data for a pitcher over a number of games and not just one game. The RQ may be calculated over a single game, a season or over a lifetime of games for a relief pitcher.

In the initial column, the inning is indicated in which the relief pitcher enters. This can, of course, be in any inning, but, as noted above, the RQ only takes into account the seventh, eighth and ninth-plus innings. Because a game can include extra innings, and should the game go into such extra innings, the same variables, factors and constants as used for the ninth inning may also used for any succeeding inning(s).

The second column provides an "Inning Factor." It will be noted that the Inning Factor increases from Inning 7 to Inning 8 to Inning 9. The Inning Factor is designated as "Fi".

The third column in FIG. 1A lists a factor reflecting "0" or "no outs" during Innings 7, 8 and 9 , when a relief pitcher might be called in. The "Zero Out Factor" is represented by "F0"; this factor increases throughout the three final innings of the game. Thus, if a pitcher enters the seventh inning with no outs, he is not penalized. If he enters the eighth inning with no outs, and allows inherited runners to score, he is penalized. He is penalized even more, then, if he enters the ninth inning with no outs, and allows inherited runners to score. Similar factors F1 and F2 are used where there are 1 or 2 outs at the time the relief pitcher inherits a runner on base.

The fifth, seventh and ninth columns list factors $k_1$, $k_2$ and $k_3$. These factors represent parameters that are associated with inherited runners on first base, second base and third base, respectively. It will be noted that the factors $k_1$, $k_2$ and $k_3$ decrease as the position of the inherited runner moves up from first to second to third base. Therefore, if an inherited runner on first base scores, the pitcher will be penalized more severely than if he enters the game with an inherited runner on third base, and that runner scores.

The fourth, sixth and eighth columns set forth the inherited runners on respective bases that may be found when the relief pitcher enters the game. With the aforementioned data entered into the respective columns, a first component, "$V_0$," is computed as follows:

$$V_0 = Fi \times [(k1 \times R1) + (k2 \times R2) + (k3 \times R3)] + F0 \times [(k1 \times R1) + (k2 \times R2) + (k3 \times R3)].$$

The value $V_0$ is computed for each inning during which inherited runners are on base when a relief pitcher enters the game. In the example given in FIG. 1A, in the $7^{th}$ Inning, this relief pitcher has inherited one player on $1^{st}$ base and one player on $3^{rd}$ base. This yields a quantity $V_0$=4.00. In the example shown in FIG. 1A, $V_0$=50, on the basis of four inherited runners on first base, three inherited runners on second base and two inherited runners on third base, in the eighth inning, with no outs, and $V_0$=52, on the basis of two inherited runners on first base, two inherited runners on second base and three inherited runners on third base in the ninth inning with no outs. In both cases, the $V_0$ values are added to the V0 value associated with the seventh and ninth innings for a total value of $V_0$=106.

Similar computations are performed for FIGS. 1B and 1C, in which the factors $k_1$ $k_2$ and $k_3$ are the same. The only difference from the first set of columns is that in the first column in this set (FIG. 1B), there is "one out" when the pitcher enters the game. For this reason, the first out factor F1 differs from the value F0 of column 3 in FIG. 1A. Thus, it will be noted that F1, for the same inning, will increase when there is one out, as opposed to no outs. Therefore, the pitcher is being more severely penalized if he enters the game with one out and an inherited runner scores than he would be if he had entered the game with no outs and that same runner scored. Again, using the same expression (2) above, values of $V_1$ are computed for each inning as follows:

$$V_1=Fi\times[(k1\times R1)+(k2\times R2)+(k3\times R3)]+F1\times[(k1\times R1)+(k2\times R2)+(k3\times R3)].$$

In this case, the total of the $V_1$ values is 139.

Finally, referring to FIG. 1C, similar computations are performed for the last seven columns in which the constants are the same with the exception that the first column for F2 is increased even further than the corresponding factors or values F0 and F1. For the same reasons mentioned previously, this is to penalize the pitcher more severely in the event that an inherited runner scores when there are two outs when the relief pitcher comes into the game. Again, using the same expression (2), the values $V_2$ are computed for each inning as follows:

$$V_2=Fi\times[(k1\times R1)+(k2\times R2)+(k3\times R3)]+F2\times[(k1\times R1)+(k2\times R2)+(k3\times R3)].$$

In the example shown in FIG. 1C, the total of $V_2$ is equal to 172 on the basis of two runs in the seventh and ninth innings with players on first base.

It will be noted that each of the quantities $V_0$, $V_1$ and $V_2$ (equations 2, 3 and 4) reflects the number of runs scored, with each run R modified or weighted by the factor multipliers.

The RQ can now been computed as follows, using formula (1) and using k=1 and B=270:

$$RQ = \frac{1(V_0 + V_1 + V_2)}{B}$$

In the example illustrated, where the pitcher faced 270 batters, $$RQ=1(106+139+172)\div 270$$

$$RQ=1.54.$$

The constant "1" is not critical for purposes of the present invention and is merely a scaling factor that can be selected to scale the general resulting computation to a number that is manageable, easy to remember or otherwise convenient. The RQ may also be scaled to a number that is generally consistent with other baseball averages, as both fans and clubs may be more familiar and more comfortable with them.

As indicated in FIG. 1A, with a total of 90 batters faced by this relief pitcher, without any outs, the RQ may be computed as $$RQ=106.00\div 90=1.18.$$

Similarly, considering the relief pitcher's performance when he is brought in when there is one out, FIG. 1B shows one player on $1^{st}$ base and one runner on $2^{nd}$ base in the $7^{th}$ Innings. This translates into $V_1$=4.00. In the $8^{th}$ Innings, this relief pitcher has had four inherited runners on $1^{st}$ base, three runners on $2^{nd}$ and two runners on $3^{rd}$ for a $V_1$=70.00. Likewise, in the $9^{th}$ Innings, this pitcher has had two runners on $1^{st}$, two runners on $2^{nd}$ and three runners on $3^{rd}$ base for a $V_1$=65.00. The three values of $V_1$, summed, equal 139.00, which, when divided by B=90 total batters faced with one out, translates to an RQ of 1.54.

Finally, in FIG. 1C, this same relief pitcher is shown to have been exposed to one inherited runner on $1^{st}$ base and one on $3^{rd}$ base in the $7^{th}$ Innings, which again translates into a $V_2$=4.00. In the $8^{th}$ Innings, he has had four inherited runners on $1^{st}$, three on $2^{nd}$ and two on $3^{rd}$, for $V_2$=90.00. Two inherited runners on $1^{st}$, two on $2^{nd}$ and three $3^{rd}$ occurred in the $9^{th}$ Inning, for a $V_2$=78.00. The total of the $V_2$ quantities is, therefore, 172.00. Considering a total of 90 batters faced in relief, with two outs, the RQ comes out to be 1.91. It should be noted, in this connection, that the number of inherited runners in FIGS. 1A, 1B and 1C are identical in this hypothetical example. Yet the total values for $V_0$, $V_1$ and $V_2$ differ. This is because of the different weighing factors that penalize the pitcher under certain circumstances. Considering all of the games in which the pitcher was called in and had to deal with inherited runners, the overall performance of this relief pitcher can be computed as the sum of all the "V"-quantities, namely, $V_0$, $V_1$ and $V_2$, divided by the total batters faced in relief, which, in the example, turns out to be 270. This provides a "lifetime" RQ for this relief pitcher of 1.54.

In FIGS. 2A, 2B and 2C, similar computations are made in which different numbers of inherited runners are found on different bases with different numbers of outs. Here, using similar computations, the overall or "lifetime" RQ for the second pitcher is 1.74, after having faced a total of 215 batters. Similar computations can, of course, be made for all pitchers who are called during the later innings of a game to relieve an existing pitcher and who are faced with inherited runners on base.

All these RQ numbers can then saved in a database and compared to each other. It is possible, then, to also compare relief pitchers insofar as their performance is concerned when called into a game with no outs but with inherited runners on base. In the two examples shown, in FIGS. 1A and 2A, the pitcher represented by the figures in 1A is the superior pitcher, as his RQ is 1.18, whereas the second pitcher has an RQ of 1.52. If both of these relief pitchers are on the same team, a manager of a baseball club, may decide in a critical game, to use the first relief pitcher under circumstances in which there are no outs. The same would be true if such relief pitchers were compared at a time when there is one out when a relief pitcher was needed, the first pitcher having an RQ, under those circumstances, of 1.54, while the second pitcher has an RQ of 1.64. Finally, if required to select a relief pitcher in any game in which there are two outs and inherited runners exist, the first relief pitcher has still demonstrated that he performs better under those conditions, have an RQ=1.91, whereas the second pitcher has an RQ of 2.49. Such superior performance is also reflected in the "lifetime" or overall better RQ for the first pitcher of 1.54 as compared to the "lifetime" RQ of the second pitcher, which is equal to 1.74.

The distinctions between the RQ and ERA become immediately evident. Thus, for example, in a nine-inning game, with three outs per inning, there are a total of 27 outs. In the ideal game, therefore, there are 27 batters out in one game. T/he ERA, as noted above, is equal to the number of runs divided by the number of batters, itself divided by 27 (the number of outs). Therefore, in the ideal game, the number of runs is equal to zero, and the ERA is equal to zero. However, if the number of runs is equal to 1, the ERA is equal to 1. If the pitcher faces 54 batters, the ERA is equal to 0.5. Stated otherwise, the ERA is a reflection of the number of runners who have scored for every 27 outs. However, this is without regard to the number of inherited runners, the number of innings in which the runs were scored, the bases on which the inherited runners were on, etc. However, the RQ provides more information about the real performance of the relief pitcher. Thus, the greater the number of inherited runners that score, the higher the RQ. The RQ also increases if such runs are scored in later innings, or from lower bases.

It will be evident, therefore, that the RQ provides a more accurate and more complete picture of the capabilities or performance of a relief pitcher in the circumstances described. By using the formula for the RQ, in its broader or more refined form, a numerical value can be placed on what the relief pitcher has saved. In other words, "a save is not a save is not a save." All saves are not equal. The RQ in accordance with the present invention makes the necessary adjustment to reflect this and serves as a valuable tool and criterion for analysis when comparing relief pitchers in the final innings of a baseball game.

Although this invention has been described in detail with particular reference to preferred embodiments thereof, it will be understood that variations and modifications may be effected within the spirit and scope of the invention as described herein and as defined in the appended claims. Thus, for example, formulas (2)–(4) can be modified to add, delete or give different weights to any of the factors that serve as multipliers for the runs R1, R2 and/or R3. The "out" factors F0, F1 and F2 may be discounted or made equal to zero. While this simplifies the computation, it eliminates the ability of those working with the data to vary the weight of the statistics to runs scored when there are different numbers of outs at the time that the relief pitcher is called in. It should also be clear that each of the factors (e.g., k1, k2, k3) can be adjusted to penalize a pitcher more or less as conditions vary. The factors can be incrementally increased or decreased, or can be inverted and adjusted as a divisor instead of a multiplier in the equations (e.g., $(R1 \div k_1)$ instead of $(R1 \times k_1)$ as in equation (3)). Additional factors not currently reflected in the equations for the RQ might also be added—such as, for example, whether the game is a night game, poor weather conditions (e.g., rain)—all of which may make it easier or more difficult for a pitcher to perform well.

As suggested previously, the exponent "n" can be any value that provides desired or reasonable values for RQ. Thus, in the above expression (1), "n" can be whole integers, fractions or any other numeric quantity. In accordance with the currently preferred realizations, normally n=1 or n=−1. Thus, in the example suggested by expression (4), RQ has been computed with n=1, so that the quantity $(V_0+V_1+V_2)$ remains in the numerator while the quantity B remains in the denominator, yielding RQ=1.91 when k=1.

It is clear that when n=1, the RQ is proportional to the number of runs R scored and inversely proportional to the number of batters faced in the final innings of the game, so that as the ability of the relief increases, the RQ decreases. By scaling the constant k, RQ can be greater or less than one. If an inverse relationship is desired, "n" can be made equal to −1, which thereby places "B" in the numerator and "R" in the denominator. Again, k can be selected to provide any scale factor.

However, when n=1, as the ability of the relief pitcher improves, the RQ decreases. Again, the absolute values can be adjusted by selecting a suitable value of k. In the examples given, with k remaining at 1, selecting n=−1 would make RQ=1×(90÷172)=0.523, instead of 1.91. It will be clear that reversing the sign of the exponent "n" simply reverses the trend for the pitchers—either the RQ increases or decreases as the player exhibits more and more (or less and less) skill.

The above method may be presented in terms of program procedures executed on a computer or network of computers. These procedural descriptions and representations are the means used by those skilled in the art to most effectively convey the substance of their work to others skilled in the art.

Here, generally, a "procedure" is conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared, and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to those quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine operations. Useful machines for performing the operations of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove convenient to construct more specialized apparatus to perform the required method steps. The required structure for a variety of these machines will appear from the description given.

FIG. 3A illustrates a computer of a type suitable for carrying out the invention. Viewed externally in FIG. 3A, a computer system has a central processing unit 100 having disk drives 110A and 110B. Disk drive indications 110A and 110B are merely symbolic of a number of disk drives which might be accommodated by the computer system. Typically, these would include a floppy disk drive such as 110A, a hard disk drive (not shown externally) and a CD ROM or DVD drive indicated by slot 110B. The number and type of drives vary, typically, with different computer configurations. The computer has a display 120 upon which information is displayed. A keyboard 130 and mouse 140 are typically also available as input devices. The computer illustrated in FIG. 1A may be a SPARC workstation from Sun Microsystems, Inc.

Figure 3B:
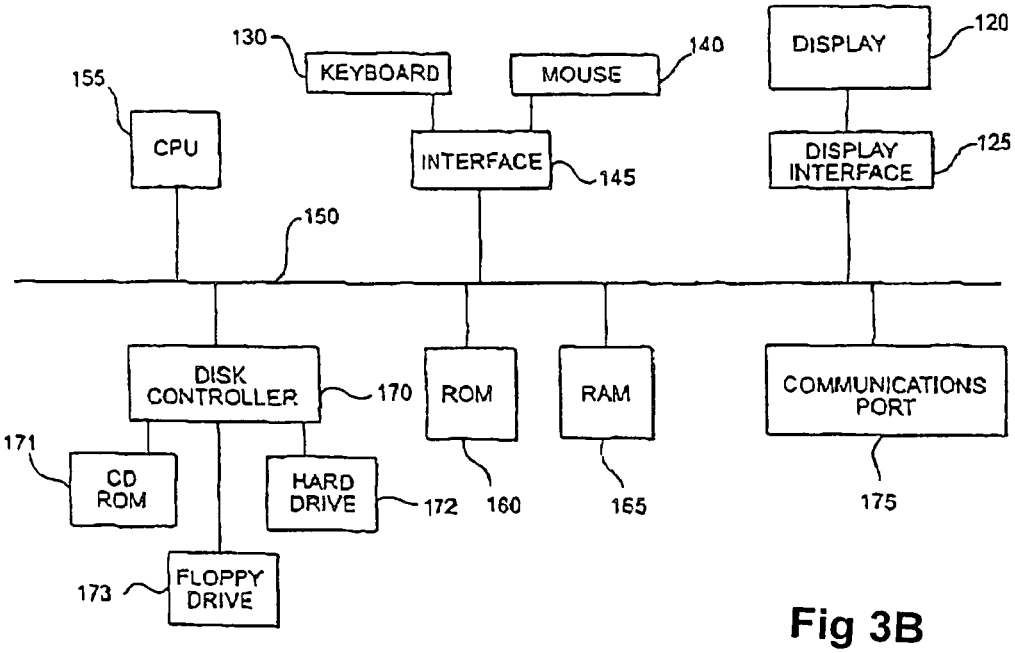
FIG. 3B is a block diagram of an exemplary hardware configuration of the computer of FIG. 3A.

FIG. 3B illustrates a block diagram of the internal hardware of the computer of FIG. 3A. A bus 150 serves as the main information highway interconnecting the other components of the computer. CPU 155 is the central processing unit of the system, performing calculations and logic operations required to execute programs. Read only memory (160) and random access memory (165) constitute the main memory of the computer. Disk controller 170 interfaces one or more disk drives to the system bus 150. These disk drives may be floppy disk drives, such as 173, internal or external hard drives, such as 172, or CD ROM or DVD (Digital Video Disks) drives such as 171. A display interface 125 interfaces a display 120 and permits information from the bus to be viewed on display. Communications with external devices can occur over communications port 175. A data base of any conventional or suitable format may be provided and stored on any of the storage media 171, 172, 173, etc.

Figure 4:
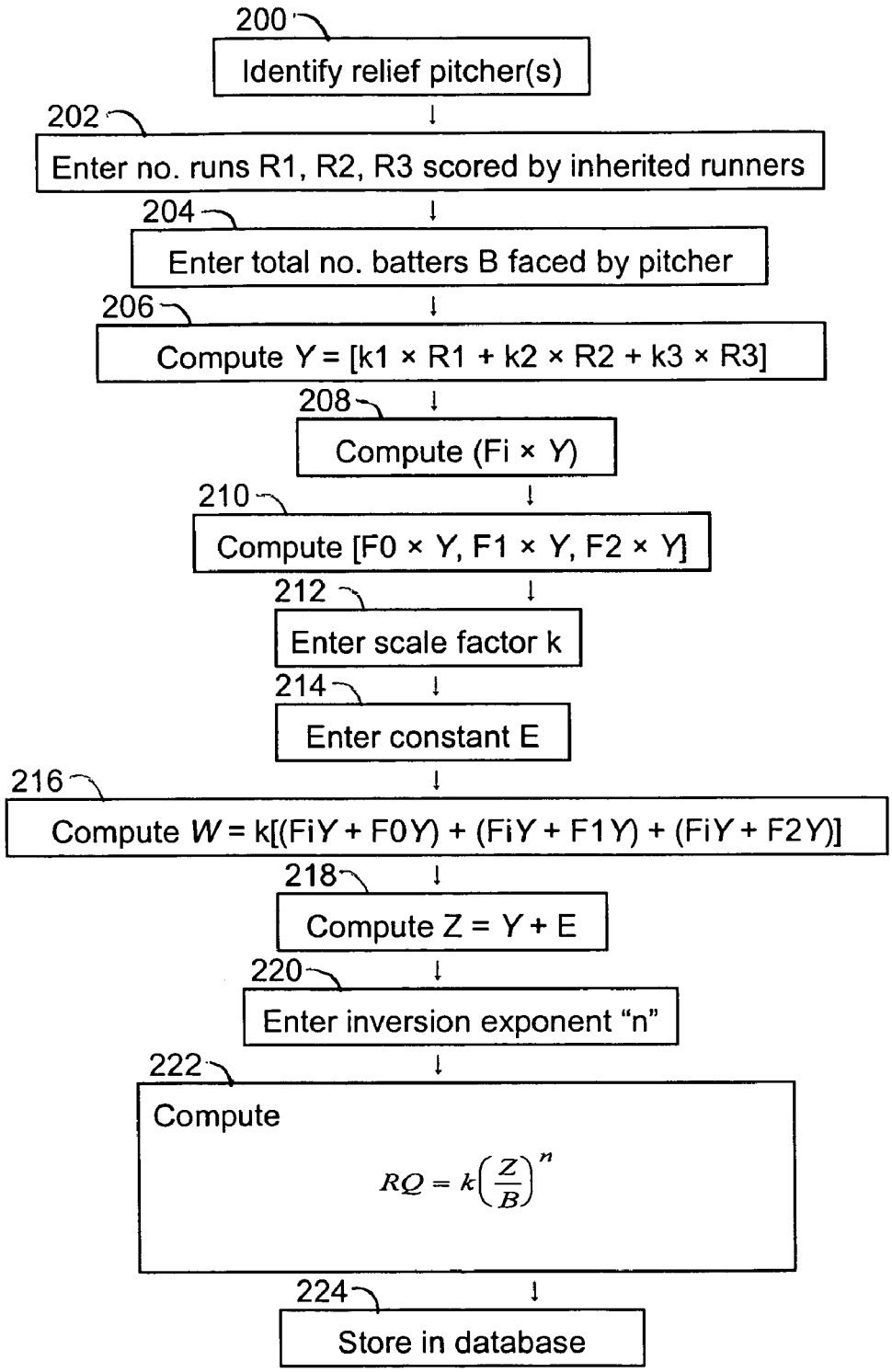
FIG. 4 is a block diagram illustrating the method of computing the runs quotient RQ in accordance with the invention, which is preferably performed by a computer of the type shown in FIGS. 3A and 3B.

Referring to FIG. 4, a block diagram is shown that illustrates the method of computing the runs quotients RQ in accordance with the invention, which is preferably performed by a computer of the type shown in FIGS. 3A and 3B. When performed by a computer, FIG. 4 illustrates the data that is entered into the computer as well as the computations performed by the computer on the basis of certain desired characteristics or properties for the RQ. Initially, a database needs to be created for each relief pitcher or group or universe of pitchers. To do this, the identity of each individual pitcher is inputted into the computer at 200. For that given pitcher, the number of runs "R1," "R2" and "R3" is then inputted, representing the runs scored by the players that have been inherited by the relief pitcher, at 202. At 204, the total number of batters "B" are entered or inputted that have been faced by the relief pitcher. Once the aforementioned information has been inputted, the computer is instructed to compute a quantity Y=[(k1×R1)+(k2×R2)+(k3×R3)], at 206. Once the quantity Y has been computed, that quantity is multiplied by the Inning Factor Fi, (Fi×Y), at 208, and the base factors F0, F1 and F2 are used to obtain the products (F0×Y), (F1×Y) and (F2×Y), at 210.

As aforementioned, the quantities can be scaled up or down depending on the general size or magnitude of the desired RQ quantity. The scale factor "k" is entered at 212, and a parameter E is entered at 214. As will become evident, the parameter E at 214 can be 1 or 0 or any desired quantity.

At 216 an intermediate quantity W is then computed by multiplying the intermediate quantity Y in accordance with the following relationship:

$$W=k[(FiY+F0Y)+(FiY+F1Y)+(FiY+F2Y)].$$

At 218 another intermediate parameter, Z, is computed to be equal to:

$$Z=W+E.$$

An inversion exponent "n" is then inputted at 220, depending what the preference is to have the RQ quantity increase with better relief pitcher performance, or whether the quantity needs to be decreased. It should be clear, therefore, that for positive values of "n", lower values of the RQ parameter represent pitchers who have performed better, while the quantities increases as the performance decreases. The reverse is true for negative values of the inversion exponent "n", since a negative exponent will invert the value of the RQ quotient, so that the larger the quantity, the better the performance.

The RQ is computed at 222 in accordance with the following relationship:

$$RQ = k\left(\frac{Ri+E}{B}\right)^n.$$

This quantity can then be stored in a suitable database, at 224. The computation of the RQ can be simplified if "E" is made equal to 0. However, the quantity "E" has been include in the generalized formula to accommodate the situation in which the inversion exponent "n" is negative, and the quantity "W" is equal to 0, as this would lead to very large, and even infinite, quantities for RQ. In this way, even if the quantity "W" is equal to 0, the ratio B/W can still be made to be a finite quantity. However, when the inversion exponent "n" is positive, the quantity W remains in the numerator, and the quantity E may be superfluous, and may be omitted. Under the conditions of the positive values of "n", the basic equation for the RQ can be reduced to:

$$RQ = \left(\frac{W}{B}\right)^n$$

Figure 5:
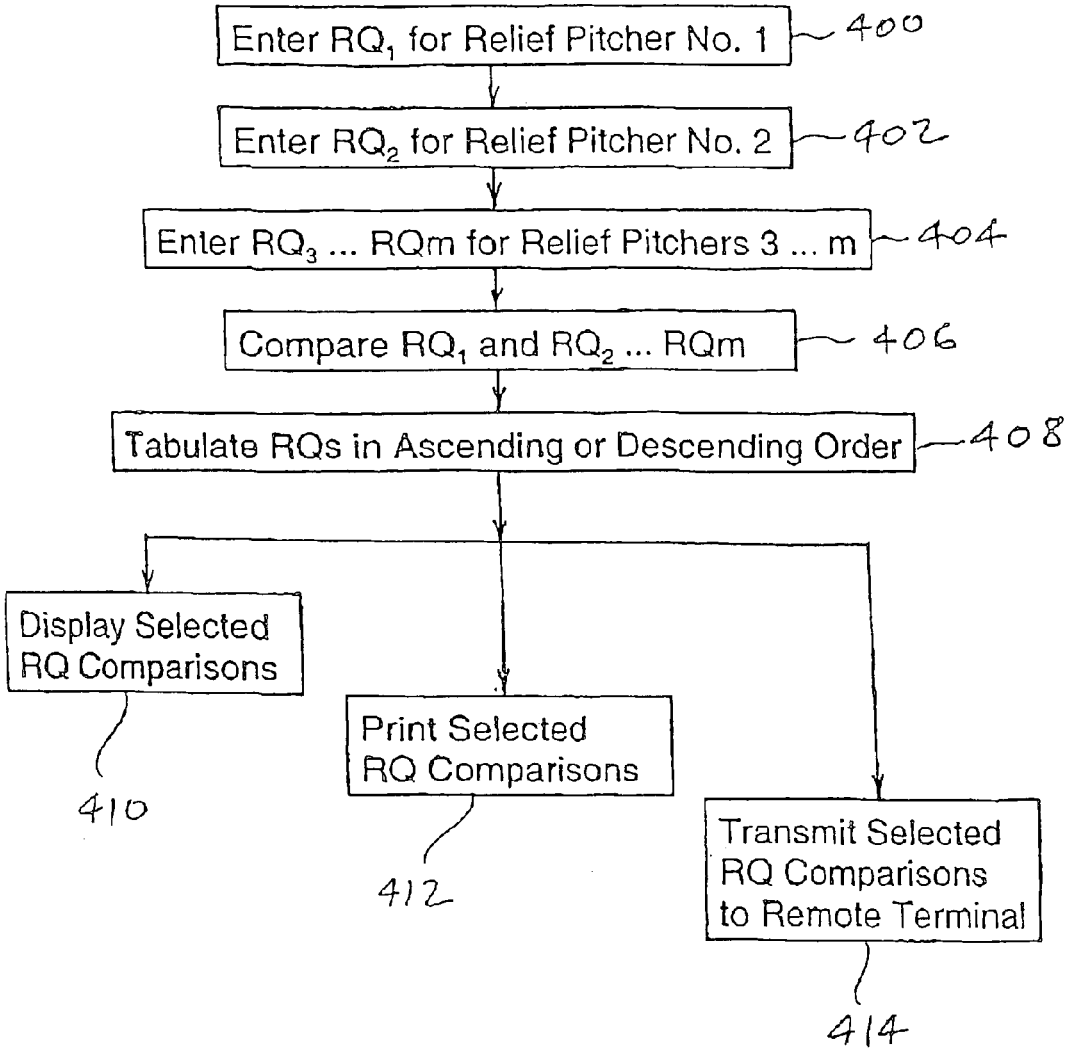
FIG. 5 is a block diagram illustrating the manner in which RQ factors for two or more relief pitchers can be compared, displayed, printed and/or transmitted to a remote terminal or location.

In FIG. 5 a practical application of the invention is illustrated. After the RQ is calculated for all relief pitchers of interest, this information is stored in a database, at 400, 402, 404. Once the "RQ"s—RQ1, RQ2 . . . RQm—have been stored, this information can readily be used to compare the RQ for any given pitcher to those of the others, at 406. This information can then be tabulated or displayed in any desired format, such as ascending or descending order, at 408. Once structured or tabulated, the information can be displayed, at 410, printed, at 412, or transmitted to a remote terminal, at 414.

It should be evident that this information presented as suggested would be extremely useful to owners of sports teams, managers, fans, sports publications and the like, both to appreciate the relative performances of relief pitchers and for assessing future decisions on the basis of past performance.

What is claimed is:

1. A method of evaluating the performance of a relief pitcher in the late innings of a baseball game in which the pitcher inherits at least one player on base, the method comprising the steps of establishing the number of runs Ri scored by such inherited runners; establishing the number of batters B faced in such innings; evaluating the Relief Quotient "RQ", where:

$$RQ = k\left(\frac{Ri+E}{B}\right)^n$$

where k is first a predetermined constant selected to scale the RQ to a desired range of magnitudes, n is a second predetermined constant that may be positive or negative and E is a parameter that may be an integer or equal to 0 ; and storing RQ in a tangible medium for subsequent use.

2. A method as defined in claim 1, wherein the runs Ri are modified or weighed by at least one factor reflecting a condition in the baseball game at the time that the relief pitcher is brought into the game.

3. A method as defined in claim 2, wherein the runs Ri are modified by a plurality of weighted factors.

4. A method as defined in claim 2, wherein said factor is a function of the number of the inning.

5. A method as defined in claim 4, wherein said factor increases for each subsequent inning.

6. A method as defined in claim 2, wherein said factor is a function of the number of outs.

7. A method as defined in claim 6, wherein said factor increases as the game moves through the innings.

8. A method as defined in claim 6, wherein said factor increases with the number of outs.

9. A method as defined in claim 2, wherein said factor is a function of the base on which the inherited runner is on.

10. A method as defined in claim 9, wherein said factor decreases as the base number increases.

11. A method as defined in claim 1, wherein a constant "k" is selected to provide an RQ in the range of 1–10.

12. A method as defined in claim 1, wherein said RQ is computed on the basis of a pitcher's performance within at least a part of one season.

13. A method as defined in claim 1, wherein said RQ is compiled on a pitcher's performance over a lifetime of pitching.

14. A method as defined in claim 1, wherein the RQ is compiled as follows:

$$RQ = \{\{k \times [Fi[(k1 \times R1) + (k2 \times R2) + (k3 \times R3)] + F0[(k1 \times R1) + (k2 \times R2) + (k3 \times R3)] + Fi[(k1 \times R1) + (k2 \times R2) + (k3 \times R3)] + F1[(k1 \times R1) + (k2 \times R2) + (k3 \times R3)] + Fi[(k1 \times R1) + (k2 \times R2) + (k3 \times R3)] + F2[(k1 \times R1) + (k2 \times R2) + (k3 \times R3)]] + E\} \div B\}^n,$$

wherein k is a scaling factor;

k1, k2 and k3 are all base scaling factors;

Fi is the Inning Factor;

F0, F1 and F2 are the "No. of Out" Factors;

Ri, R2 and R3 are Base Factors;

n is a predetermined constant that may be positive or negative;

E is an arbitrary factor for use particularly when "n" is a negative number; and B is the total number of batters faced by the pitcher.

15. A method as defined in claim 1, wherein n is positive.

16. A method as defined in claim 1, wherein n is negative.

17. An apparatus for evaluating the performance of a relief pitcher in the final innings of a baseball game in which the pitcher inherits at least one player on base, comprising:

means for establishing the number of runs Ri scored by such inherited runner;

means for establishing the number of batters B faced in such innings;

means for evaluating the Relief Quotient "RQ", where:

$$RQ = k\left(\frac{Ri + E}{B}\right)^n,$$

and k is first a predetermined constant selected to scale the RQ to a desired range of magnitudes and n is a second predetermined constant; and means for storing RQ in a tangible medium for subsequent use.

18. An apparatus as defined in claim 17, wherein said evaluation means comprises a computer programmed to perform the required computations when the number of runs (Ri) number of batters faced (B) are entered.

19. An apparatus as defined in claim 17, wherein n is positive.

20. An apparatus as defined in claim 17, wherein n is negative.

21. A device for evaluating or comparing the performance or efficiency of a relief pitcher in the final innings of a baseball game in which the pitcher inherits at least one player on base, the device comprising means for providing a quantity defined as follows:

$$RQ=k*((Ri+E)/B)**n,$$

where Ri is equal to the number of runs scored by the inherited runners, B is the number of batters faced by the pitcher and k is a first predetermined constant selected to scale the RQ to a desired range of magnitudes and n is a second predetermined constant, said quantity being storable in a tangible medium for subsequent use.

22. A device as defined in claim 21, wherein the RQ is compiled as follows:

$$RQ = \{\{k \times [Fi[(k1 \times R1) + (k2 \times R2) + (k3 \times R3)] + F0[(k1 \times R1) + (k2 \times R2) + (k3 \times R3)] + Fi[(k1 \times R1) + (k2 \times R2) + (k3 \times R3)] + F1[(k1 \times R1) + (k2 \times R2) + (k3 \times R3)] + Fi[(k1 \times R1) + (k2 \times R2) + (k3 \times R3)] + F2[(k1 \times R1) + (k2 \times R2) + (k3 \times R3)]] + E\} \div B\}^n,$$

wherein k is a scaling factor;

k1, k2 and k3 are all base scaling factors;

Fi is the Inning Factor;

F0, F1 and F2 are the "No. of Out" Factors;

R1, R2 and R3 are Base Factors;

n is a predetermined constant that may be positive or negative;

E is an arbitrary factor for use particularly when "n" is a negative number; and B is the total number of batters faced by the pitcher.

23. A device as defined in claim 21, wherein k is selected to provide an RQ in the range of 1–10.

24. A device as defined in claim 21, wherein said RQ is computed on the basis of a pitcher's performance within at least a part of one season.

25. A device as defined in claim 21, wherein said RQ is compiled on a pitcher's performance over a lifetime of pitching.

26. A device as defined in claim 21, wherein n is positive.

27. A device as defined in claim 21, wherein n is negative.

28. A method of evaluating a performance measure of a relief pitcher in a baseball game, wherein same relief pitcher inherits at least one player on base upon entering the game, the method comprising:

a first step of establishing the number of runs Ri scored by such inherited runners;

a second step of establishing the number of batters B faced in such innings;

a third step of calculating a Relief Quotient "RQ":

$$RQ = k\left(\frac{Ri + E}{B}\right)^n,$$

wherein k is first a predetermined constant selected to scale the RQ relative to a desired range of magnitudes suitable for easy comparison, and n is a second predetermined constant selected from a group including at least one of +1 and −1, and E is a parameter that may be an integer or equal to 0; and storing RQ in a tangible medium for subsequent use.

29. A method of calculating a performance measure of a relief pitcher in a baseball game, wherein said relief pitcher inherits at least one player on base upon entering the game, the method comprising:

a first step of establishing the number of runs Ri scored by such inherited runners;

a second step of establishing the number of batters B faced in such innings;

a third step of calculating a Relief Quotient "RQ":

$$RQ = k\left(\frac{Ri + E}{B}\right)^n,$$

wherein k is first a predetermined constant selected to scale the RQ relative to a desired range of magnitudes suitable for easy comparison, and n is a second predetermined constant selected from a group including at least one of +1 and −1, and E is a parameter that may be an integer or equal to 0; and storing RQ in a tangible medium for subsequent use.

30. A method of calculating a performance measure of a designated relief pitcher in a selected baseball game relative to a calculated average of a plurality of relief pitchers in a plurality of baseball games, wherein each said relief pitcher inherits at least one player on base upon entering the game, the method comprising:

a first step of monitoring and recording a performance of said plurality of relief pitchers in said plurality of baseball games wherein said step of recordation includes the recordation, for each relief pitcher, of the number of runs Ri scored by such inherited runners and the recordation of the number of batters B faced in all such innings;

a second step of calculating and recording a Relief Quotient "RQ" as a performance measure for each of said plurality of relief pitchers in an accessible database in accordance with the following equation:

$$RQ = k\left(\frac{Ri + E}{B}\right)^n,$$

wherein k is first a predetermined constant selected to scale the RQ relative to a desired range of magnitudes suitable for easy comparison, and n is a second predetermined constant selected from a group including at least one of +1 and −1, and E is a parameter that may be an integer or equal to 0;

a third step of calculating and recording an average Relief Quotient and a best possible Relief Quotient of said plurality of relief pitchers in said accessible database;

a fourth step of monitoring and recording a performance of said designated relief pitcher in said selected baseball game;

a fifth step of calculating and recording a Relief Quotient "RQ" of said designated relief pitcher in said database according to said equation;

a sixth step of comparing said Relief Quotient from said designated relief pitcher to at least one of said average Relief Quotient and said best possible Relief Quotient to evaluate said performance of said designated relief pitcher; and storing RQ in a tangible medium for subsequent use in at least one of said third through sixth steps.

* * * * *